United States Patent [19]

Niinuma

[11] Patent Number: 4,675,486

[45] Date of Patent: Jun. 23, 1987

[54] PUSH BUTTON SWITCH WITH SLIDING CONTACT MEMBER

[75] Inventor: Akira Niinuma, Furukawa, Japan

[73] Assignee: Alps Electric Co., Ltd., Japan

[21] Appl. No.: 881,580

[22] Filed: Jul. 2, 1986

Related U.S. Application Data

[63] Continuation of Ser. No. 674,183, Nov. 23, 1984, abandoned.

[30] Foreign Application Priority Data

Nov. 21, 1983 [JP] Japan ..... 58-179830[U]

[51] Int. Cl.[4] ..... H01H 1/42

[52] U.S. Cl. ..... 200/255; 200/16 F; 200/157 A; 200/282; 200/163; 200/340

[58] Field of Search ..... 200/254–256, 200/162, 163, 16 R, 16 F, 16 B, 16 C, 276, 282, 340

[56] References Cited

U.S. PATENT DOCUMENTS

| | | | |
|---|---|---|---|
| 1,448,058 | 3/1923 | Eis et al. | 200/163 |
| 1,636,678 | 7/1927 | Benson | 200/163 |
| 2,326,942 | 8/1943 | Hetherington | 200/163 |
| 4,016,377 | 4/1977 | Iwasaki | 200/16 F |
| 4,086,546 | 4/1978 | Fulp et al. | 200/16 F X |
| 4,187,417 | 2/1980 | Zehel et al. | 200/254 |
| 4,209,682 | 6/1980 | Rood | 200/159 R |
| 4,291,210 | 9/1981 | Wolber et al. | 200/252 |
| 4,313,685 | 2/1982 | Stahl et al. | 200/276 X |
| 4,393,283 | 7/1982 | Masuda | 200/254 |
| 4,488,018 | 12/1984 | Hayashida | 200/16 F |

*Primary Examiner*—Stephen Marcus
*Assistant Examiner*—Ernest G. Cusick
*Attorney, Agent, or Firm*—Guy W. Shoup

[57] ABSTRACT

A compact pushbutton switch comprises a housing in which three chambers are formed and connected by a common contact member. A fixed contact, a nonconducting member forming a continuation to the fixed contact, a slider movable along both the fixed contact and the nonconducting member, a movable contact fixed to the slider, a control pushbutton mounted to the slider, and a coiled spring are mounted in each of the chambers. The spring is made of an electrically conductive material, and interposed between the common contact member and the movable contact to bias the movable contact out of contact with the fixed contact. When no control pushbuttons are depressed, each spring acts to hold the movable contact out of electrical connection with the fixed contact. When any one of the pushbuttons is depressed, the corresponding spring serves to establish an electrical connection between the corresponding movable contact and fixed contact by its electrical conductive property.

1 Claim, 4 Drawing Figures

PUSH BUTTON SWITCH WITH SLIDING CONTACT MEMBER

This is a continuation application from application Ser. No. 674,183 filed Nov. 23, 1984 now abandoned.

FIELD OF THE INVENTION

The present invention relates to a compact switch which gives the operator a comfortable feel when it is operated by the operator.

BACKGROUND OF THE INVENTION

In one kind of conventional switch, a movable contact is brought into engagement with a selected fixed contact to switch one circuit to another. In another kind of conventional switch, a resilient member is formed integrally with one fixed contact so that the member can be brought into resilient contact with the other fixed contact, for the same purpose. In these conventional switches, a spring is typically provided to bias a slider or the like in one direction. Therefore, there are certain limits to miniaturization of those switches.

SUMMARY OF THE INVENTION

In view of the foregoing problems with the prior art devices, it is the main object of the present invention to provide a compact switch which is made up of a minimum number of components and which gives the operator a comfortable feel when it is operated by the operator.

This object is achieved in accordance with the teachings of the present invention by providing a switch having a housing with a plurality of operation chambers. A metallic common contact member extends along the bottoms of the operation chambers, and each of the operation chambers includes a metallic fixed contact extending upwardly within the operation chamber so as to be perpendicular with the common contact member. A respective nonconducting member made of an insulating material and forming a continuation of the fixed contact is formed in each operation chamber, and a slider is adapted to slide along both the fixed contact and the nonconducting member. A metallic movable contact is fixedly mounted to the slider to engage the fixed contact or the nonconducting member, and a spring made from an electrically conductive material is interposed between the common contact member and the movable contact to connect them together electrically.

Other objects, advantages and features of the invention will be apparent from the following description of the preferred embodiment taken in conjunction with the accompanying drawings.

DETAILED DESCRIPTION OF THE INVENTION

Figure 1:
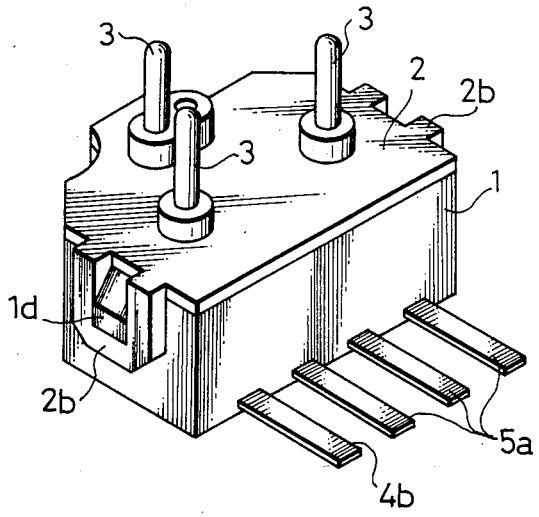
FIG. 1 is a perspective view of a switch according to the present invention.

Referring to the drawings, there is shown a three-pole switch embodying the concept of the present invention. This switch includes a cover 2 mounted on a housing 1 and three control pushbuttons 3 extending through the cover 2. When any one of the pushbuttons 3 is depressed inwardly of the housing, the corresponding one of three fixed contacts 5 shown in FIG. 4 is electrically connected with a common contact member 4 made of a metal.

Figure 2:
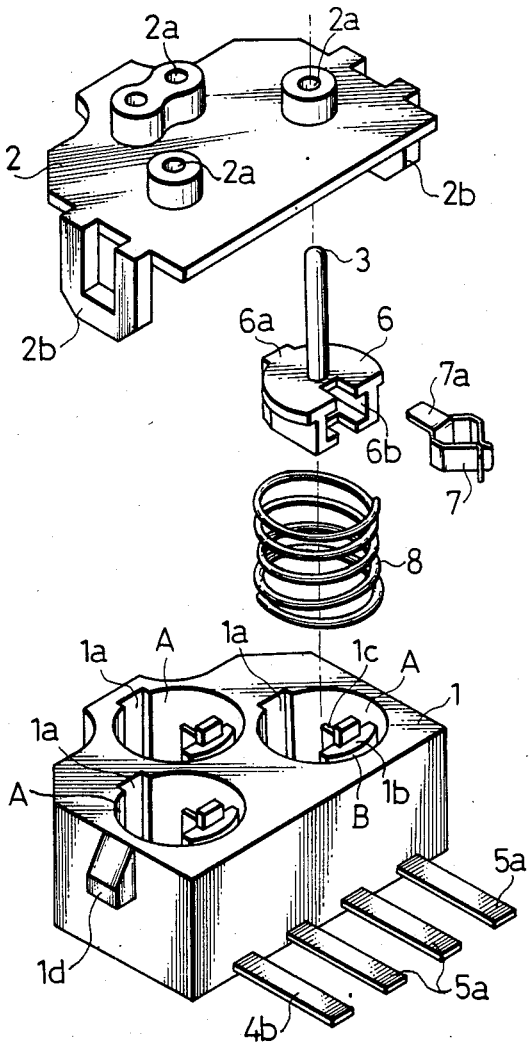
FIG. 2 is an exploded perspective view of the switch shown in FIG. 1.

The housing 1 is made from an insulating material, and is provided with three concave operation chambers A as shown in FIG. 2. Each chamber A takes a circular form in cross section. A guide groove 1*a* extends vertically along each chamber A. A support member 1*b* is formed integrally with each operation chamber A, and extends upwardly from the bottom of the housing 1. The support members 1*b* are spaced from the side wall of the respective chamber A to form a groove B between the outer surface of the support member 1*b* and the inner surface of the operation chamber A. A respective spring 8 is received within each chamber A and fits within the groove B, as can be seen in FIG. 3.

Figure 3:
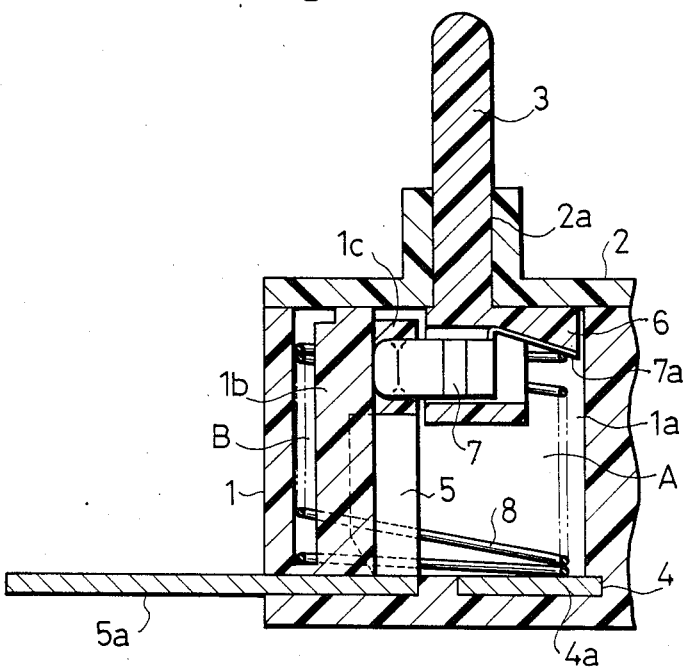
FIG. 3 is a cross-sectional view of one of the operation chambers in the switch shown in FIG. 1.

As shown in FIG. 3, the inner end of the groove B is at a position slightly higher than the bottom of the chamber A. The upper portion of each support member 1*b* has a nonconducting member 1*c* facing inwardly of the corresponding operation chamber A. The nonconducting member 1*c* is made from the same insulating material as the housing 1, and is formed integrally with the support member 1*b* so as to have a broad, flat shape corresponding to the shape of the fixed contact 5.

Figure 4:
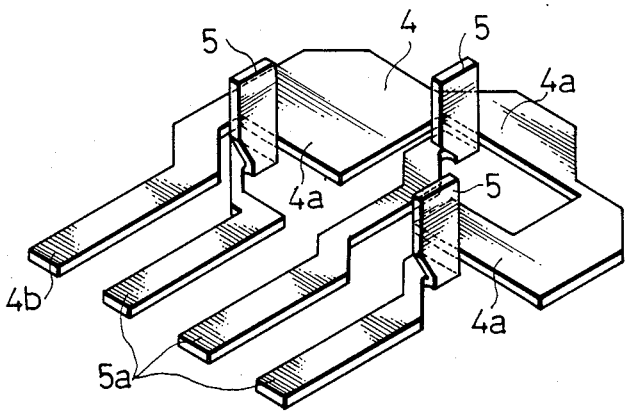
FIG. 4 is a perspective view of the common contact member and the fixed contacts of the switch shown in FIG. 1.

The common contact member 4 is made of a metal sheet, shaped into the form shown in FIG. 4, and inserted in the bottom of the housing 1. The contact member 4 has three portions 4*a* each fitted within a respective operation chamber A and occupying about half of the area of the bottom of the respective operation chamber A, as shown in FIG. 3. A terminal 4*b* is formed integrally with one end of the common contact member 4, and extends outwardly of the housing 1. Each of the fixed contacts 5 is also made of a metal sheet, and is inserted in the bottom of the housing 1. Each fixed contact 5 is held to a respective support member 1*b* in the operation chamber A, and extends vertically, as shown in FIG. 3, below the corresponding nonconducting member 1*c*. As shown in FIG. 4, the lower end of the fixed contact 5 is bent at right angles to form a terminal 5*a* which extends outwardly of the housing 1.

Mounted to the bottom of each of the control pushbuttons 3 is a slider 6 that is formed from an insulating material integrally with the lever 3. Each slider 6 is shaped so as to be substantially identical with a part of the operation chamber A in cross section. A protrusion 6*a* extends radially from the slider 6 and is adapted to fit in the groove 1*a* to permit the slider 6 to smoothly slide vertically in the operation chamber A without twisting. The slider 6 is provided with a radial slot 6*b* for receiving a movable contact 7. The movable contact 7 is made of a metal sheet, and has two spring arms adapted to surround and hold either the fixed contact 5 or the nonconducting member 1*c*. When the slider 6 is installed in the operation chamber A, the movable contact 7 surrounds the nonconducting member 1*c* or the fixed contact 5 and makes contact with it. A conductive element 7*a* is formed integrally with the rear portion of the movable contact 7. Under the condition that the movable contact 7 is fixed in the slider 6, the conductive element 7*a* extends into the chamber A through the rear portion of the slider 6, as shown in FIG. 3.

Also mounted in each operation chamber A is a coiled spring 8 that is made from an electrically conductive material. The spring 8 is installed along the inner surface of the chamber A and, accordingly, it is partially received in the groove B. As shown in FIG. 3, a portion of the lower end of the spring 8 bears on the opposed portions 4*a* of the common contact member 4, while the remaining portion bears on the inner end of the groove B. Since this inner end of the groove B is at a position slightly higher than the bottom of the chamber A, the spring 8 is not in contact with the fixed contacts 5. The upper end of the spring 8 bears on the conductive element 7*a* of the movable contact 7. That is, the movable contact 7 is electrically connected with the common contact member 4 via the spring 8.

The cover 2 is made from an insulating material. Apertured projections 2*b* depend integrally from opposite ends of the cover 2 and are adapted to engage protrusions 1*d* formed on opposing lateral sides of the housing 1 to hold the cover 2 onto the housing 1. The cover 2 is also provided with three holes 2*a* to receive the control pushbuttons 3.

In the operation of the switch constructed as described above, the sliders 6 are biased in such a direction that the corresponding control pushbutton 3 extends upwardly from the cover 2, as viewed in FIG. 3, by the resilience of the coiled spring 8. Under this condition, the movable contact 7 surrounds the nonconducting member 1*c* and is in contact with it. Since the member 1*c* is formed integrally with the housing 1 from an insulating material, the movable contact 7 is not electrically connected with the fixed contact 5. Therefore, the contact member 4 which is electrically connected via the spring 8 with the movable contact 7 is also not electrically connected with the fixed, contact 5.

Then, when any one of the control pushbuttons 3 protruding from the cover 2 is depressed, the slider 6 integral with the depressed pushbutton 3 is moved toward the bottom of the corresponding operation chamber against the resilience of the spring 8. When the slider 6 has been moved slightly, the movable contact 7 slides from the non-conducting member 1*c* and comes to engage the corresponding fixed contact 5, so that the movable contact 7 is electrically connected with the fixed contact 5. The result is that the fixed contact 5 is electrically connected with the common contact member 4 through the movable contact 7 and the spring 8. That is, when any one of the three control pushbuttons 3 is depressed, the corresponding fixed contact 5 is electrically connected with the common contact member 4, thus completing the circuit.

In the novel switch thus far described, the nonconducting members 1*c* form a continuous extension with respective fixed contact 5 without any change in thickness. Each movable contact 7 slides upwardly and downwardly within the respective operation chamber A while holding the corresponding fixed contact 5 or nonconducting member 1*c*. Hence, while the slider 6 is being moved, the resistance that the movable contact 7 experiences during its sliding movement is kept constant. For this reason, the resistance to the operated control pushbutton 3 is always maintained constant and the operator thus obtains a stable feeling when the operator operates the pushbutton. Further, each movable contact 7 is designed so as to be able to stably bear on the corresponding fixed contact 5 even if it is not large. Accordingly, each movable contact 7 can be made in minimum dimensions. This makes it possible to reduce the resistance to movement of the sliding movable contact 7 and the operated control pushbutton 3.

Further, in the illustrative embodiment, each movable contact 7 is held just below the corresponding control pushbutton 3, thereby reducing the distance between the point of application at which a force is exerted on the slider 6 and the position at which the movable contact 7 slides. Therefore, the movement applied to the slider 6 is small, rendering operation of the slider 6 smooth. Another advantage comes from the fact that the point of application at which a controlling force is exerted on the slider 6 and the position at which the movable contact 7 slides coincide with the central position of the reaction of the coiled spring 8, because the upper end of the spring 8 bears on the periphery of the slider 6, and because the pushbutton 3 and the movable contact 7 lie at the center of the circle described by the spring 8. Consequently, the slider 6 is operated smoothly.

As can be understood from the foregoing description, the present invention enjoys various advantages as follows. (1) The fixed contact and the nonconducting member forming a continuation of the fixed contact are mounted in the operation chamber of the housing. The movable contact fixed to the slider is held in sliding contact with either the fixed contact or the nonconducting member. Accordingly, the movable contact produces the same resistance whether it is in contact with the fixed contact or the nonconducting member. Consequently, whenever the slider is operated, it exerts the same resistance, thus giving the operator a comfortable feeling. (2) The common contact member and one of the movable contacts are electrically connected together through the corresponding conductive coiled spring. The corresponding fixed contact is electrically connected with the common contact member via the spring by a movement of the slider. That is, the spring combines the function of biasing the slider with the function of completing the circuit. As a consequence, the switch is made up of a minimum number of components, and can be fabricated compactly.

Since many variations, modifications and changes in detail can be made to the embodiment described above, it is intended that all matter in the foregoing description and shown in the accompanying drawings be interpreted as illustrative and not in a limiting sense.

What is claimed is:

1. A switch comprising:

a housing;

a plurality of chambers formed in said housing;

a metallic common contact member extending along the bottom of each chamber;

each of said chambers having an upright nonconducting support extending perpendicularly to said common contact member, a nonconducting member formed with planar sides extending upright in parallel with and formed integrally with said support and made of the same material as said support, a metallic fixed contact mounted to said support extending upright in parallel therewith and having planar sides dimensioned and positioned so as to be flush and in linear alignment with the planar sides of said nonconducting member, a slider adapted to slide reciprocally along said fixed contact and nonconducting member, a metallic movable contact fixedly mounted to the slider and adapted to surround and hold itself in contact with the planar sides of the fixed contact or nonconducting member depending on the position of the slider, a spring made of an electrically conductive material and interposed between said common contact member and said movable contact so as to form an electrical connection therebetwen, and means for moving said slider between a nonconducting position wherein said movable contact holds said nonconducting member and a conducting position wherein said movable contact holds itself in electrical contact with said fixed contact, wherein said spring is a coiled spring adapted to bias the movable contact toward said nonconducting position, and wherein said movable contact, holder, nonconducting member and fixed contact are positioned with the space inside the coils of said coiled spring, whereby a smooth transition by said slider in switching said movable contact between said conducting and nonconducting positions is provided when said switch is operated.

* * * * *